United States Patent [19]

Gamberini et al.

[11] Patent Number: 4,899,889

[45] Date of Patent: Feb. 13, 1990

[54] DEVICE FOR MONITORING THE QUALITY OF CIGARETTES IN A PACKAGING MACHINE

[75] Inventors: Antonio Gamberini, Bologna; marco Brini, San Lazzaro di Savena, both of Italy

[73] Assignee: G. D. Societa Per Azioni, Bologna, Italy

[21] Appl. No.: 128,884

[22] Filed: Dec. 4, 1987

[30] Foreign Application Priority Data

Dec. 17, 1986 [IT] Italy ..... 3611 A/86

[51] Int. Cl.[4] ..... B07C 5/00; A24C 5/343

[52] U.S. Cl. ..... 209/535; 53/54; 73/81; 131/907

[58] Field of Search ..... 209/535-537; 53/54, 498, 499, 500, 53, 148-151; 73/81; 131/282, 283, 904, 905, 907, 908

[56] References Cited

U.S. PATENT DOCUMENTS

| | | | |
|---|---|---|---|
| 2,008,870 | 7/1935 | Little | 53/54 X |
| 3,116,478 | 12/1963 | Powell | 131/904 X |
| 3,207,308 | 9/1965 | Kemp | 209/535 |
| 3,368,674 | 2/1968 | Koeppe | 209/535 |
| 3,722,172 | 3/1973 | Seragnoli | 53/54 |
| 3,771,279 | 11/1973 | Seragnoli | 53/151 X |
| 4,142,406 | 3/1979 | Focke | 209/536 X |
| 4,363,332 | 12/1982 | Preston et al. | 209/535 X |
| 4,445,520 | 5/1984 | Knight et al. | 131/282 |
| 4,592,470 | 6/1986 | Mattei et al. | 209/535 |
| 4,612,803 | 9/1986 | Manservisi et al. | 209/535 X |
| 4,644,152 | 2/1987 | Gurioli | 209/535 X |
| 4,742,668 | 5/1988 | Ecabert | 53/498 X |

FOREIGN PATENT DOCUMENTS

| | | | |
|---|---|---|---|
| 2311084 | 9/1974 | Fed. Rep. of Germany | 131/282 |
| 0432709 | 6/1975 | U.S.S.R. | 53/499 |
| 0974463 | 11/1964 | United Kingdom | 209/535 |
| 1048655 | 11/1966 | United Kingdom | 209/535 |
| 1298785 | 12/1972 | United Kingdom . | |
| 2023994 | 1/1980 | United Kingdom . | |

*Primary Examiner*—Margaret A. Focarino
*Assistant Examiner*—Edward M. Wacyra
*Attorney, Agent, or Firm*—Cushman, Darby & Cushman

[57] ABSTRACT

Packaging is effected in a machine where correct filter-tipping and filling of the ends of the single cigarettes occupying the channels of a feed chute is monitored by a plurality of plungers, one to each channel, that are reciprocated axially toward and away from the ends of respective single cigarettes during the course of the work cycle. Each plunger carries a radial appendage, offered to a transducer by which a control signal will be produced in the event that the appendage assumes a given position on arrival of the plunger in contact with the end of the cigarette lying in its path.

2 Claims, 2 Drawing Sheets

DEVICE FOR MONITORING THE QUALITY OF CIGARETTES IN A PACKAGING MACHINE

BACKGROUND of the INVENTION

The invention disclosed relates to a control device for monitoring the quality of cigarettes fed into a packaging machine.

In conventional packaging machines, cigarettes are generally fed to the wrapping line from a chute provided internally with baffles by which adjacent channels are created, in number to suit the number of cigarettes contained in a pack. The cigarettes drop down toward the bottom through the channels and emerge from the chute via three exits, each of which is designed to dispense a layer of cigarettes during the single work cycle of the packaging machine. The three layers are fed one by one into the pockets of an intermittent conveyor, where they form a group, normally of twenty cigarettes, arranged in a typical three-tiered honeycomb formation that represents the contents of one pack.

The entire body of cigarettes proceeding along the channels of the chute will normally be subjected to a quality control, generally to ascertain that the ends of each cigarette are properly filled with tobacco, or in the case of filter tips, to make sure that each of the cigarettes exhibits a filter. Such operations are usually effected by means of plunger pins located alongside each channel at a given point coinciding with the quality control station, and reciprocated axially through a path parallel with the axes of the cigarettes occupying the channels. Proceeding along the channels, the cigarettes will stop alongside the control station at a given point during each work cycle of the packaging machine, whereupon the plungers shift forward axially to the point of impinging upon their stationary ends.

In conventional devices, the position assumed by each plunger on accomplishing this axial shift may be detected in any one of a number of ways, and the result will be indicative of the conditions of the single cigarettes monitored. For example, the button of a switch may be associated with each plunger, in which case operation of the switch indicates that the end of the cigarette is correctly filled, or filter-tipped; failure of the switch to operate, on the other hand, will result in the activation of a reject signal which, in conjunction with a suitably programmed memory facility, causes the defective cigarette to be knocked out at a successive stage.

It has been discovered, however, that a quality control station of the type described above cannot guarantee the detection of every single defective cigarette, by dint of the fact that the switches utilized operate mechanically, and dependability is lost with the passage of time.

In other conventional devices utilizing plunger pins, each plunger is associated with a transducer, e.g. inductive or capacitive, positioned at right angles to the plunger and capable of sensing the position of a given part of the plunger, of greater or lesser diameter, on termination of its movement toward the cigarette.

This type of device, too, has been seen to be less than totally reliable, inasmuch as a certain degree of play will inevitably be established, again, with the passage of time, between the plungers and the holders in which they are slidably mounted, so that the plunger becomes subject to unwarranted radial movement. As the transducers, positioned normal to the pins, are highly sensitive, such radial movement can give rise to incorrect readings; for example, a small diameter part of the plunger may move radially into close proximity with the transducer as a result of the surrounding gap, the result of which is that such proximity is interpreted at a larger diameter by the transducer.

The object of the invention disclosed is to embody a quality control device, using plunger pins, that is free from the drawbacks described above, and will permit a sure verification of whether or not the cigarettes fed into the wrapping line of a packaging machine are properly filter tipped, and filled right to the end with tobacco.

SUMMARY OF THE INVENTION

The stated object is achieved with a control device as disclosed, which serves to monitor the quality of cigarettes when lying stationary at a control station in a packaging machine.

The device according to the invention comprises a plunger disposed with its axis parallel to the axes of the cigarettes, an actuator associated with and reciprocating the plunger axially between an operating position, in which the plunger enters into contact with one end of the single cigarette, and an at-rest position in which the plunger is distanced from the cigarette, a transducer associated with the plunger, and circuitry wired to the transducer that produces an output signal, or otherwise, according to the configuration assumed by the plunger when in the operating position.

It is an essential feature of the invention that the transducer, a proximity transducer, is oriented in the direction in which movement of the plunger occurs, and operated by a trigger associated rigidly with and disposed normal to the axis of the plunger.

BRIEF DESCRIPTION of the DRAWINGS

The invention will now be described in detail, by way of example, with the aid of the accompanying drawings, in which.

DESCRIPTION of the PREFERRED EMBODIMENTS

Figure 1:
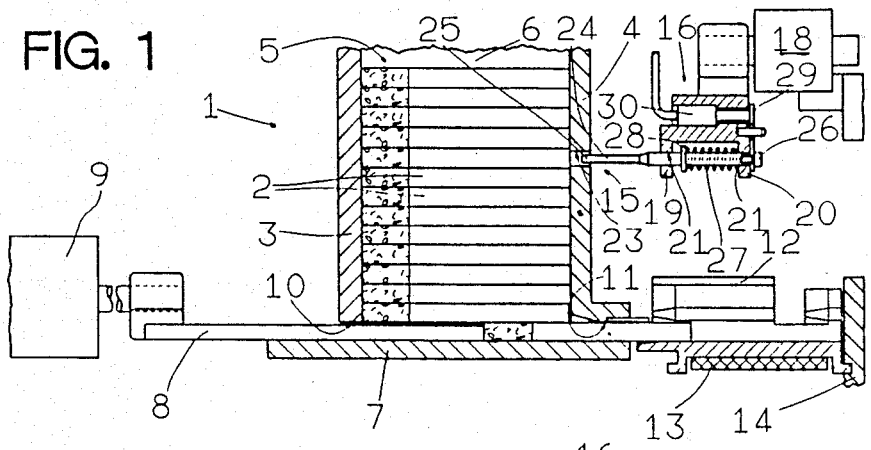
FIGS. 1, 2 & 3 are schematic representations of the quality control device according to the invention, viewed in section, showing three different operating configurations.
Figure 2:
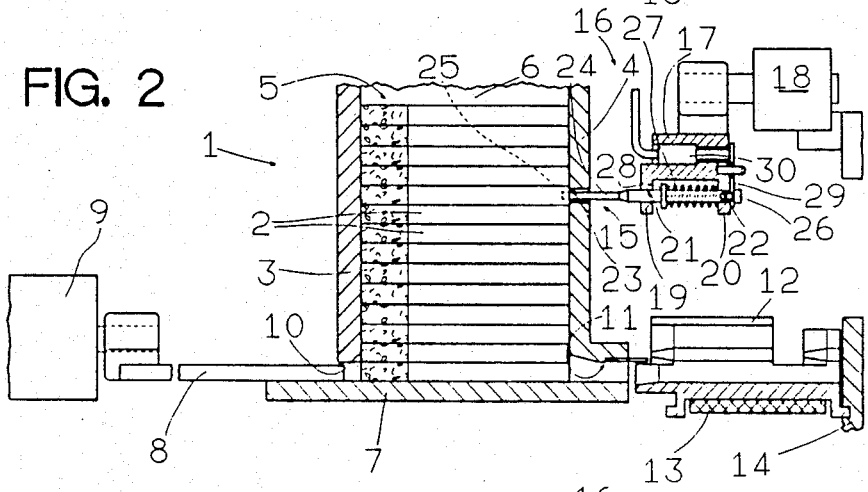
Figure 3:
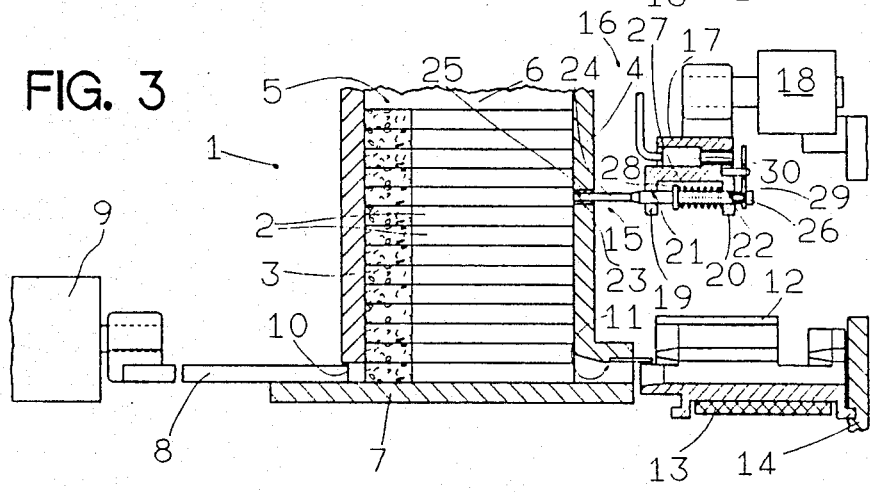

FIGS. 1 to 3 show an in-feed chute 1, conventional in embodiment, by which cigarettes 2 are supplied to a packaging machine (not illustrated).

Viewed from the standpoint of the drawings, the chute 1 comprises a left hand wall 3 and a right hand wall 4 that are vertical, parallel with one another, and create an enclosure the width of which is marginally greater than the length of a single cigarette 2. The enclosure is divided up into a plurality of channels 5 (one only of which is shown) by partitions 6 (one only of which is visible in FIGS. 1, 2 and 3) that are disposed substantially vertical and lie at right angles to the walls 3 and 4 of the chute, set apart at a distance marginally greater than the diameter of one cigarette 2.

The channels 5 are stopped at the bottom by a horizontal base 7 on which the columns of cigarettes contained in the chute come to rest. The cigarettes 2 are engaged in rows by a pusher 8 reciprocated by an actuator 9 through a direction at right angles to the walls 3 and 4 of the chute. 10 and 11 denote horizontal slots located in the respective walls 3 and 4 in alignment with the pusher 8 and adjacent to the base 7, the height of which is at least equal to the diameter of one cigarette 2.

The pusher 8 is capable of movement through the left hand slot 10 from a retracted position, outside of the chute 1 (as in FIGS. 2 and 3), to an operating position, inside the chute 1 (that of FIG. 1); moving forward thus, the pusher transfers the cigarettes 2 from the channels 5 into containers 12 (one only of which is visible) which are spaced apart equally and carried by an intermittent horizontal belt conveyor, denoted 13. Once inside the containers 12, the rows of cigarettes 2 are distanced from the chute 1 and taken toward a wrapping line (not illustrated in the drawings), riding against a stationary fence 14 that is located to the right of the conveyor 13, as seen in FIGS. 1, 2 and 3. The embodiment of the chute 1, the channels 5, the pusher 8 and the conveyor 13 is explained in detail in UK specifications Nos. 1 298 785 and 2 023 994, owned by the same owner, namely, G. D. SpA.

15 denotes a station, located along each channel 5, accommodating the device by which quality of the single cigarette 2 is monitored. The single device, denoted 16 in its entirety, will be reproduced and installed alongside each one of the channels 5, and accordingly, one only is illustrated in FIGS. 1, 2 and 3, to which the following description refers.

The device 16 is located facing the right hand side wall 4 externally of the chute 1, and comprises a frame 17 supporting actuator means 18 which are designed to produce reciprocating movement toward and away from the side wall 4 between a retracted, at-rest position, shown in FIG. 1, and an extended, operating position, illustrated in FIGS. 2 and 3. The frame 17 comprises two skirts 19 and 20 spaced apart and parallel with the side wall 4, affording relative holes 21 and 22 the axes of which lie at right angles to the side wall 4; these two holes 21 and 22 are coaxial with a hole 23 passing through the side wall 4 and located in such a way that it lies coaxial with a cigarette 2 when brought to a halt alongside the control station 15.

24 denotes a plunger, accommodated by the two holes 21 and 22 and axially slidable therein, which comprises a locator pin 25, occupying the hole 23 in the side wall 4, and a shank 26 that projects from the rear skirt 20 of the frame 17. Tension means are associated with the plunger 24, consisting in a coil spring 27 that is compressed between the rear skirt 20 and an annular projection 28 issuing from the shank at a point near the front skit 19.

Figure 4:
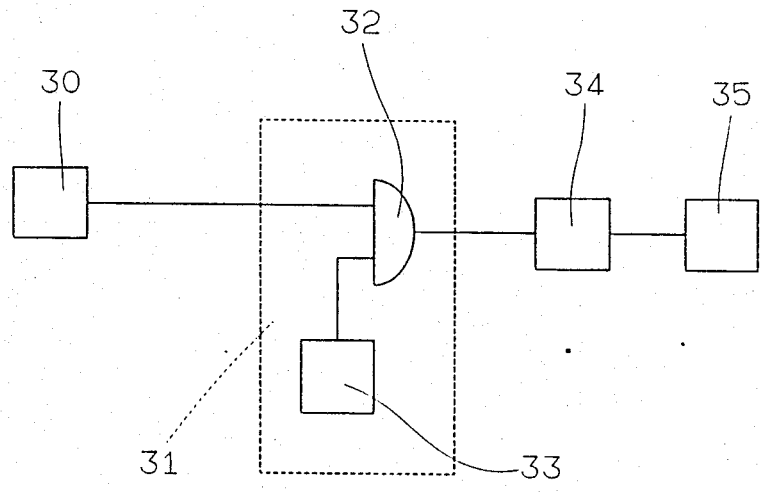
FIG. 4 is the block diagram of an electrical circuit suitable for the device of FIGS. 1, 2 and 3.

29 denotes a plate, or an appendage, that is attached rigidly to the shank 26 of the plunger 24 and extends in an upwards direction. In the example illustrated, the uppermost section of the appendage is offered to a proximity transducer 30, in the embodiment of FIGS. 1, 2 and 3, an inductive type, that is carried by the frame 17 and mounted with its longitudinal axis parallel to that of the plunger 24. It will be seen from FIG. 4 that the transducer 30 is designed to relay an electrical signal to circuitry comprising a control module, which is denoted 31 in its entirety and includes an AND gate 32 with two inputs; the first input is in receipt of the signal from the transducer 30, and the second, in receipt of a timing signal, supplied from a suitable reference source 33, which is locked to the packaging machine cycle.

Operation of the control device 16 will now be described, departing from the situation illustrated in FIG. 1, in which the configuration of the device 16 is that assumed when at rest, with the pusher 8 occupying the slot 10 and engaged in transferring one cigarette 2 from each channel 5 into the waiting container 12.

In FIGS. 2 and 3, the pusher 8 is viewed following its return to the retracted position, away from the chute 1, allowing the cigarettes 2 to descend by one step such that another cigarette 2 is brought into line with the control station 15. At the same time, the actuator 18 will have moved the frame 17 into the extended position, such that the locator pins 25 of the various plungers 24 enter into contact with the end of the cigarette 2 alongside the station in each channel 5. Once this position is effectively occupied by the frame 17, the reference source 33 will supply the timing signal to the relative input of the AND gate 32.

Two configurations of the device 16 become position; these are illustrated in FIGS. 2 and 3.

The configuration depicted in FIG. 2 reflects the situation in which the end of the cigarette 2 probed by the pin 25 is imperfectly packed with tobacco, causing the pin 25 to penetrate forward a certain distance and bring the appendage 29 substantially into contact with the transducer 30; thus, proximity of the plate 29 is sensed by the transducer 30, and the appropriate signal is relayed to the relative input of the AND gate 32.

The active state of both inputs of the AND gate 32 produces an output signal, and this is utilized to set a conventional memory circuit 34; once a given number of steps are counted off, corresponding to the passage of the defective cigarette 2 down the channel 5, the memory 34 will trigger operation of a conventional knockout device, schematically denoted by block 35, to remove the cigarette from the chute. The embodiment of such a knockut device 35 is set forth in detail in US specification No. 4 592 470, owned by the same owner, namely G. D. SpA.

The configuration of FIG. 3 reflects the situation in which the end of the single cigarette 2 probed by the pin 25 is faultlessly packed with tobacco. Here, the resistance offered to the pin will be sufficient to overcome the force of the spring 28 and disallow the plunger 24 to penetrate the cigarette 2, with the result that the plate 29 remains distanced from the transducer 30 and no signal is relayed to the AND gate 32.

With the AND gate 32 in receipt of a signal from the reference source 33 only, no output signal is passed to the memory circuit 34, and the knockout device 35 will not operate.

Monitoring of the cigarette 2 being completed, the frame 17 is returned by the actuator means 18 to its retracted, at-rest position as shown in FIG. 1.

It will be observed from the description that the drawbacks mentioned at the outset, encountered in prior art embodiments, can be overcome with the device 16 disclosed. More exactly, the adoption of inductive transducers 30 eliminates the drawbacks connected with mechanical switches, and the relative positioning of the appendages 29 and transducers 30 ensures that the device 16 will remain substantially unaffected by any radial clearance that may exist between the plunger 24 and its holes 21 and 22.

While the fundamental principle of the invention remains that described above, numerous variations might be made to the device without prejudice to the scope of the disclosure. In the embodiment described, use is made of inductive transducers 30, though it will be clear that capacitive types might be adopted with equally good effect. An additional alternative would be to replace the inductive transducers 30 with an optical type capable of responding to areas of the relative appendage 29 presenting different colors or degrees of absorption.

Again, the single transducer 30 might be mounted to the frame 17 to the rear of the plunger 24, and axially aligned with the shank 26, such that detection of its position during monitoring of the cigarettes 2 is effected in direct fashion.

Lastly, it will be seen that a quality control device 16 substantially as described might also be utilized to verify faultless packing of the tobacco at the ends of cigarettes 2 conveyed internally of the containers 12. In this instance, the devices 16 could be located to the right of the conveyor belt fence 14, as viewed in FIGS. 1, 2 and 3, with the plungers 24 passing through holes 36 formed in the fence 14 at a given location, to probe the ends of the cigarettes 2 occupying the container 12 during the pause that occurs between indexed steps of the conveyor 13.

What is claimed is:

1. A control device for monitoring at a control station on a cigarette packaging machine whether individual cigarettes are fully packed with a filling, at which control station each individual cigarette, while being monitored, is disposed with its longitudinal axis aligned in a given direction, arranged with an end oriented toward the control device, and supported in a way which prevents bodily movement of the cigarette away from the control device during monitoring, so that said end is disposed in an imaginary plane, normal to said axis and of known location;

said control device comprising:

a plunger having a longitudinal axis aligned in said given direction;

a frame;

an actuator; said frame being mounted to said actuator and said actuator being operable to move said frame a predetermined distance in said given direction between an extended position and a retracted position;

said plunger having an end arranged to contact a said end of a single cigarette at said imaginary plane in one said position of said frame, and to be spaced in said given direction form said end of said cigarette in the other said position of said frame;

longitudinally resiliently urged lost-motion permitting means mounting said plunger to said frame;

a trigger means rigidly fixed to the plunger and projecting therefrom in a direction normal to said given direction;

a proximity-sensing transducer oriented in said given direction in alignment with said trigger means, so that as said plunger is moved in said given direction, said trigger means is changed in proximity to said proximity-sensing transducer;

said predetermined distance which said actuator moves said frame, in use, being greater than the distance in said given direction between said end of said plunger and said imaginary plane when said frame is in said other position, so that as said frame is moved in said given direction, in use, from said other position to said one position, either said end of said plunger is prevented by a sufficiently fully-pack filling of said cigarette from entering said end of said cigarette, thereby preventing said trigger means from activating said proximity-sensing transducer, or is permitted by an insufficiently fully-packed filling of said cigarette to enter said end of said cigarette sufficiently to cause said trigger means to activate said proximately-sensing transducer; and a control module for a kick-out device, said control module being operatively connected with said proximity-sensing transducer for providing an activation signal for the kick-out device in response to each activation of said proximity-sensing transducer, for kicking-out each cigarette sensed to be insufficiently fully packed.

2. The control device of claim 1, wherein:

said proximity-sensing transducer is an inductive transducer.

* * * * *